US009299255B2

(12) United States Patent
Yarnold et al.

(10) Patent No.: US 9,299,255 B2
(45) Date of Patent: Mar. 29, 2016

(54) METHOD AND SYSTEM FOR PROVIDING LOCATION INFORMATION OF A VEHICLE TO A USER DEVICE

(75) Inventors: Christina Yarnold, Decatur, GA (US); Richard Bennett, Dacula, GA (US)

(73) Assignee: Verizon Telematics Inc., Atlanta, GA (US)

( * ) Notice: Subject to any disclaimer, the term of this patent is extended or adjusted under 35 U.S.C. 154(b) by 864 days.

(21) Appl. No.: 13/041,215

(22) Filed: Mar. 4, 2011

(65) Prior Publication Data

US 2011/0215949 A1 Sep. 8, 2011

Related U.S. Application Data

(60) Provisional application No. 61/310,634, filed on Mar. 4, 2010.

(51) Int. Cl.

| | |
|---|---|
| ***G08B 21/00*** | (2006.01) |
| ***G08G 1/123*** | (2006.01) |
| ***G08G 1/00*** | (2006.01) |

(52) U.S. Cl.

CPC ..... *G08G 1/123* (2013.01); *G08G 1/205* (2013.01)

(58) Field of Classification Search

CPC ..... G08G 1/123; G08G 1/205

USPC ..... 340/988–994; 701/32.4, 408; 342/357.21

See application file for complete search history.

(56) References Cited

U.S. PATENT DOCUMENTS

| | | | | |
|---|---|---|---|---|
| 6,028,537 | A * | 2/2000 | Suman et al. | 340/988 |
| 2003/0229441 | A1 * | 12/2003 | Pechatnikov et al. | 701/201 |
| 2004/0176104 | A1 * | 9/2004 | Arcens | 455/456.3 |
| 2006/0217885 | A1 * | 9/2006 | Crady et al. | 701/213 |
| 2007/0057817 | A1 * | 3/2007 | Aman | 340/933 |
| 2008/0297376 | A1 * | 12/2008 | McCall | 340/989 |

* cited by examiner

*Primary Examiner* — Mark Rushing

(57) ABSTRACT

A user device application transmits the device's location and unique identifier with a message requesting location information that corresponds to a vehicle associated with the user device's unique identifier. The application sends the request message over a communication network to a central computer. The central computer obtains location information corresponding to the vehicle from a device proximate the vehicle. The central computer compares the locations of the user device and telematics device and generates a location differential value corresponding to the distance between them. If the differential value meets predetermined criteria, the central computer causes an action, for example forwarding the location information corresponding to the vehicle to the requesting user device. Or, the central computer sends the requesting device a request denied message. The central computer may also deny the request when the vehicle is moving, or if the user device has requested the vehicle's location too frequently.

18 Claims, 2 Drawing Sheets

METHOD AND SYSTEM FOR PROVIDING LOCATION INFORMATION OF A VEHICLE TO A USER DEVICE

CROSS REFERENCE TO RELATED APPLICATIONS

This application claims priority under 35 USC sec. 119 to U.S. Provisional Patent Application 61/310,634 having a filing date of Mar. 4, 2010, which this application incorporates herein by reference in its entirety.

FIELD

The invention relates to the field of vehicle telematics, and more particularly to the providing of location information of a vehicle, or other asset, to a user device remote from the vehicle.

BACKGROUND

In the area of vehicle telematics, a vehicle telematics control unit ("TCU") in a vehicle typically includes a housing that encloses a location determining device module, for example global positioning satellite system ("GPS") circuitry, one, or more, wireless transceiver(s), such as a long range wireless telephony circuit (e.g., a cellular network transceiver circuit), a short range wireless transceiver circuit, and a medium range wireless transceiver circuit, and an interface to other vehicle electronics systems, typically using the vehicle networking bus, for example the CAN bus. The GPS and wireless circuits typically couple to a processor and memory that operates the communications circuitry and the data and information that they transmit and receive.

The wireless circuitry can transmit coordinate data that the GPS circuitry produces to a remote-from-the-vehicle, off-board, centrally located computer system serving one or more vehicles. The central computer system can make the vehicle's current location available on a display in relation to features of a map, such as roads, landmarks, and other points of interest. The central computer may be coupled to a communication network that includes, for example, a cellular telephony/data network, the internet, a private, 'walled garden' network, or other similar network, that allows devices remote from the central computer to send and receive information to and from the central computer.

A user may view a location of his car via a wireless mobile communication device (i.e. smartphone, or mobile internet device ("MID")) displayed as an icon against a map background. If the user forgets what part of a large parking lot he parked in, or which street near a concert or sporting venue he parked near, he can request that the central computer obtain the vehicle's location from its TCU and transmit it to his wireless device so he can determine where to walk to find his car.

SUMMARY

A user may view a location of his car via a wireless mobile communication device (i.e. smartphone, or mobile internet device ("MID")) displayed as an icon against a map background. If the user forgets what part of a large parking lot he parked in, or which street near a concert or sporting venue he parked near, he can request that the central computer obtain the vehicle's location from its TCU and transmit it to his wireless device so he can determine where to walk to find his car.

Instead of making a vehicle's location information available to a wireless mobile device user anytime and anywhere, an aspect regulates the transmitting of the location information to the wireless mobile device based on the proximity of the wireless mobile device to the vehicle. A telematics services provider (e.g., operator of the centrally located computer system) may wish to prevent a user having a wireless device (smartphone or MID) from chasing a stolen car, or attempting to locate and retrieve a stolen car. By limiting the providing of the vehicle's location information to a wireless mobile device that is within a predetermined distance, for example one mile, the service provider can balance precluding the user from taking matters into his own hands with providing a feature that the user can use to locate his vehicle.

In addition, the telematics services provider can configure the centrally located computer system, also sometimes referred to as a telematics operations center computer ("TOC") to preclude providing a vehicle's location information to a user's wireless mobile device if the vehicle is moving, or if the wireless mobile device, or other communication device including a wired computer, has requested a vehicle's location more than a predetermined number of times within a predetermined period. If the vehicle is within the predetermined distance, the vehicle is still (or parked), and the user device has not requested the vehicle's location more than the predetermined number of times during the predetermined threshold, then the TOC sends a message wirelessly to the wireless user device with a location message. The location message contains information that the wireless device can use to generate a map with an icon that indicates the location of the vehicle.

If the TOC determines that the location differential value ("Δ") representing the distance between the locations of the vehicle and the user device is greater than the predetermined distance, the TOC, or other device that has performed the steps of determining Δ causes an action based on the differential value. For example, if Δ is greater than the predetermined distance, the TOC can send a message to the requesting wireless mobile device that causes it to indicate to a user that the location request message was denied. In addition, the TOC can send a message causing the requesting user device to indicate a location request denial if the vehicle is moving, or if the user device has requested the location of the vehicle more than the predetermined number of times during the predetermined period.

DETAILED DESCRIPTION

Figure 1:
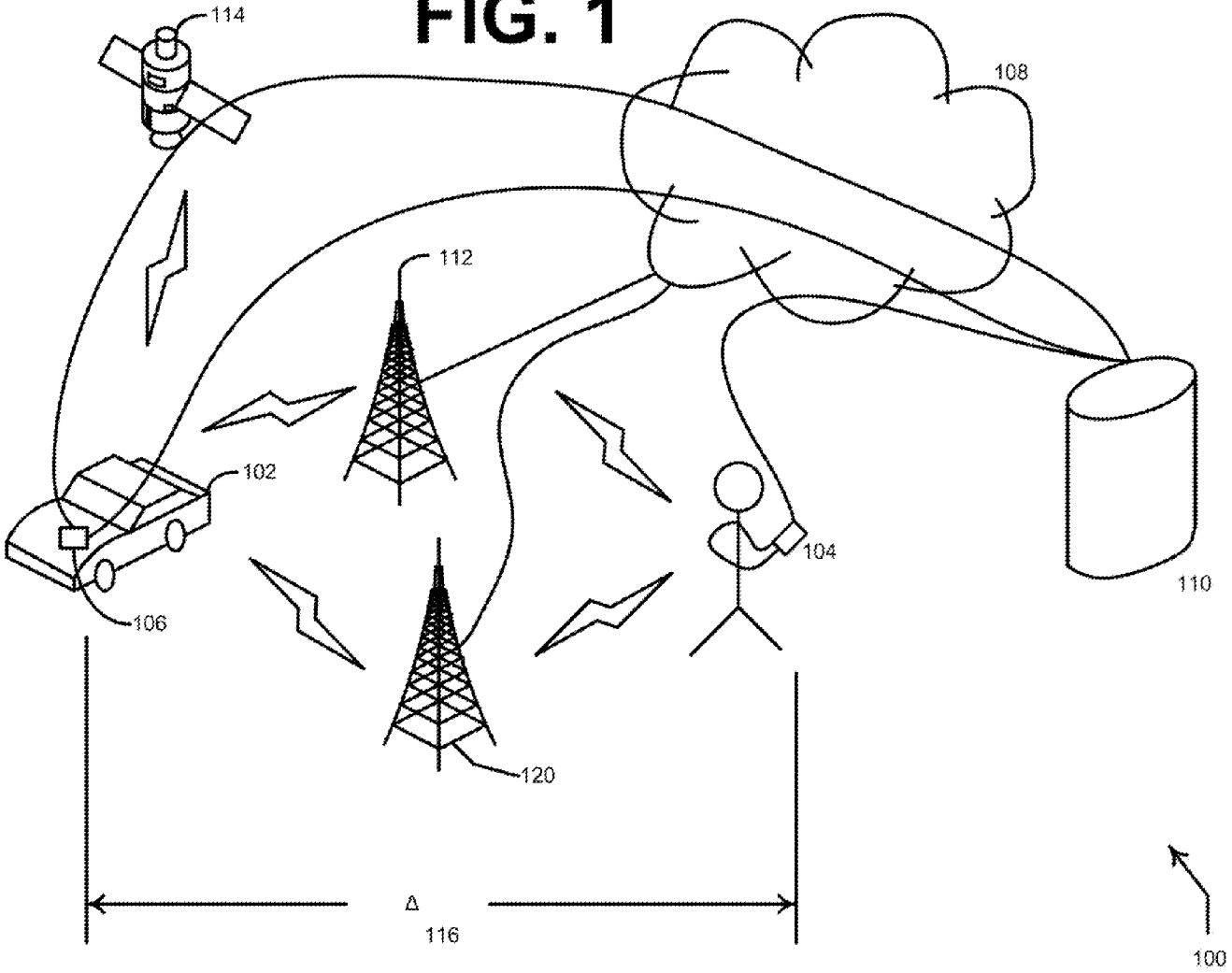
FIG. 1 illustrates a system for providing location information of a vehicle.

Turning now to the drawings, FIG. 1 illustrates a system 100 for providing location information regarding a vehicle 102 to a requesting user device 104. The location information of vehicle 102 typically originates from a vehicle device 106, such as a TCU. A vehicle manufacturer may have fixed vehicle device 106 into its corresponding vehicle during manufacture. Or, a driver may have installed an aftermarket telematics device to a diagnostic port of the vehicle. In addition, vehicle device 10 may include an aftermarket navigation device that includes a cellular module/modem that can transmit and receive signals over a voice channel or over a data channel. Alternatively, vehicle device 106 may include a smartphone or MID proximate to the corresponding vehicle. In this last aspect, a driver/subscriber to telematics services may have associated his smartphone or MID with the TOC by relating a unique identifier of the smartphone or MID, or other wireless mobile device with the vehicle's VIN. For purposes of the description herein, reference to vehicle device 106 will include reference to any device that the TOC associates with a vehicle if the asset it is associated with is a vehicle. As described herein infra, some assets that a user may seek the location of may not have a unique identifier such as a VIN. In those cases, the TOC may relate the unique identifier of device 106 with a textual name, for example.

Vehicle device 106 and user device 104 typically communicate over a communication network 108. The devices communicate over network 108 with central computer system 110. In the preferred embodiment, computer 110 includes a TOC. Many components, technologies, and protocols may compose communication network 108, and one skilled in the art will appreciate that network 108 can comprise multiple networks, such as cellular telephony and data networks, a Multiprotocol Label Switching ("MPLS") network, the Internet, and other similar networks that can couple to one another. In the preferred embodiment shown in the figure, vehicle device 106 and user device 104 communicate wirelessly via wireless communication network 112, which may compose network 108. Wireless network 112 typically comprises many cellular towers and typically vehicle device 106 and user device 104 establish communication links with different towers, although if both devices are located close to one another, they may communicate with the same tower. In addition, vehicle device 106 communicates with a satellite system 114, which may include GPS satellites and communication satellites. In another aspect, user device 104 may also communicate with satellite system 112. Network 108 can also include a wi-fi network, or similar, that devices 104 and 106 use to couple to network 108.

Vehicle device 106 (and perhaps user device 104) may receive signals from GPS satellites in system 112 to use in determining its location. Typically, vehicle device 106 processes location data from satellites 112 into location information that may include latitude and longitude coordinate values in addition to other information that one skilled in the art would know the location information to contain. The vehicle device 106 may transmit these coordinate values to computer 110, or to user device 104, for further processing. Or, vehicle device 106 may perform further processing itself.

One aspect of the processing of location information is to determine the position differential value Δ 116. In the figure, the device performing the processing of location information determines the distance 116 between the vehicle device and the user device. One skilled in the art will appreciate that the processing of location data to determine the value of Δ can occur on the user device 104, the vehicle device 106, or the central computer 110. In addition to causing the user device to generate a message indicating the location of the vehicle device 106, the device performing the processing can cause the user device to generate a message either audible, visual, tactile, or a combination of all stimulus types, that the distance Δ 116 is greater than a predetermined value. If distance Δ 116 exceeds the predetermined limit, then the message produced by the user device may include a message that a request for location of the vehicle has been denied.

For example, if a user holding wireless user device 104 (e.g. a smartphone) using an application thereon, requests the location of his vehicle 102 to display on a map rendered on the user device, the user device application may send the request message, along with a unique identifier and location information corresponding to the user device to computer 110. Computer 110 may then perform a table lookup based on the unique identifier received in the location request message, and then either determine from information stored thereon the most recent location of vehicle device 106, or generate and send a message to vehicle device 106 requesting the current location thereof. In this aspect, central computer 110 may have associated the unique identifier of the requesting device with a unique identifier of the vehicle/asset, or with an account number that associates device 104 and 106 with one another. Alternatively, computer 110 (or vehicle device 106 or user device 104) may request a login and password, or similar credentials, before providing information regarding the location of vehicle device 106 to the device requesting the location of the vehicle.

After obtaining the location of vehicle device 106, computer 110 (or whichever device is running the application that is processing the information) determines the distance 116 between the user device 104 and the vehicle device 106. Then, computer 110 compares the determined distance 116 with predetermined criteria and either provides the location information of the vehicle device to the user device, or provides a message for the user device to produce that conveys that the location request has been denied (which would occur if the distance 116 exceeds predetermined criterion of, for example, one mile).

Figure 2:
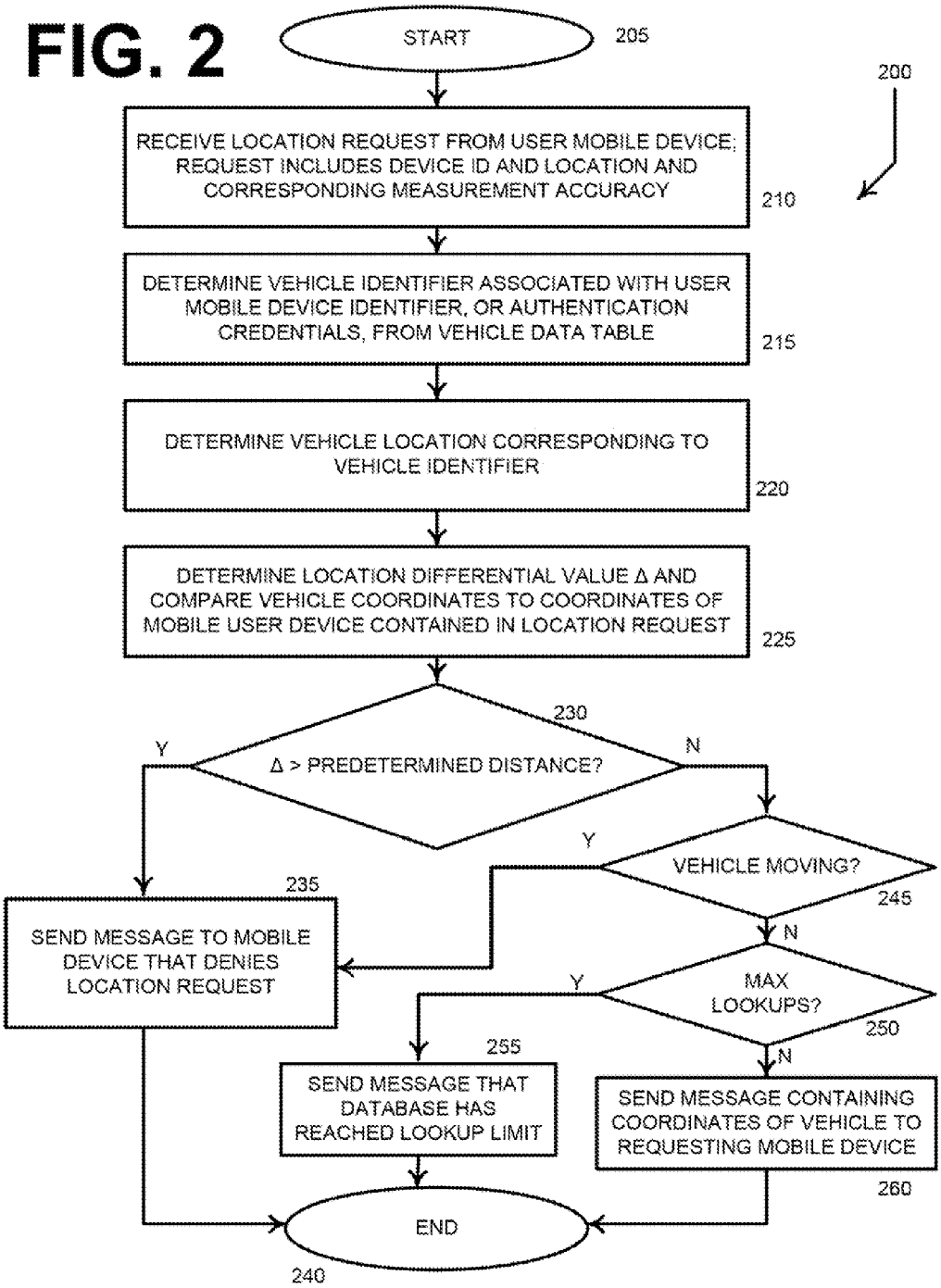
FIG. 2 illustrates as flow diagram of a method for configuring a central computer for determining a vehicle's location and providing it to a user device.

Turning now to FIG. 2, the figure illustrates a flow diagram of a method 200 for configuring a central computer for determining a vehicle's location and providing it to a user device. Method 200 begins at step 205. At step 210, the central computer, which may be referred to herein as a TOC, receives a location request message from a user device that requests the location of a particular vehicle. The request message typically contains a unique identifier corresponding to the requesting device. The unique identifier may be the wireless device's IMEI, EMSI, MSISDN, or other similar identifier that substantially permanently corresponds to the requesting user device.

The TOC receives the request message at step 215, and uses the unique identifier corresponding to the user device to perform a table lookup in a field of a table indexed on unique identifier. The table may associate a customer's mobile user device (or other device) identifier with the user's—typically a subscriber of services offered by the operator of the TOC—vehicle's vehicle identification number ("VIN"). The TOC then can access information and data relative to the VIN and process it and send it according the request if certain conditions are met.

One will appreciate that the table, and processing of data and information contained thereon, can reside on the TOC, or on the user device, or on the vehicle device.

At step 220, the TOC determines the location coordinates of the vehicle corresponding to the VIN determined at step 215. The TOC may determine the current location of the vehicle by sending a request message wirelessly to the vehicle TCU requesting that it transmit back to the TOC its current location latitude and longitude coordinates. The TCU may determine the location coordinates from the GPS circuitry, from triangulation over the wireless communication circuits, or other similar techiques. In addition, the TOC may determine the current location of the vehicle by retrieving from a memory the most recent coordinates sent from the TCU to the TOC, if the TOC has been configured to store historical location coordinates of the vehicle.

At step 225, the TOC compares the current location coordinates corresponding to the wireless user device that sent the request at step 210 with the most recent coordinates of the TCU/vehicle determined at step 220. As a result of the comparison, the TOC generates, and perhaps stores to a memory, the distance Δ between the vehicle and the requesting device.

At step 230, the TOC compares the Δ to a configurable predetermined criterion of maximum distance. If the result of the comparison is that the Δ is greater that the criterion (i.e., the user device that sent the request at step 210 is farther than, for example, one mile, from the location of the vehicle) then the TOC sends a request denied message to the requesting device, and perhaps the TCU, at step 235, and the method ends at step 240.

If, however, at step 230 the TOC determines that Δ is less than the predetermined maximum distance criterion, then the TOC determines at step 245 whether the vehicle is moving. The TOC may determine this by comparing the past few periodically received location coordinates transmitted from the TCU. Typically, the TCU transmits current location information periodically, such as, for example, every two minutes. If, for example, the past two location coordinates differ, then method 200 advances to step 235 and proceeds as described above.

If the TOC determines that the past two location coordinate sets (a set is a latitude and longitude coordinate corresponding to a location) are the same, then the TOC assume the vehicle is not moving, and method 200 advances to step 250.

At step 250, the TOC determines whether the user device has sent a request for location of the vehicle more than a predetermined number of times during a predetermined period. A user device that has requested the vehicle's location many times during the predetermined period could indicate that the user has nefarious intentions in requesting the vehicle's location. If the TOC determines that the maximum number of lookups during the period has occurred, method 200 sends a message to the requesting user device that the maximum number of lookups occurred and ends at step 240. If, however, the TOC determines at step that the maximum number of lookups has not occurred during the predetermined period, the TOC sends a current location message to the requesting wireless mobile user device, or other device that requested the location information of the vehicle. The current location message contains the coordinates of the current location of the vehicle. The requesting user device can then display an icon, or other indication, representing the current location of the vehicle on a map, and method 200 ends at step 240. In addition to displaying the location on a map, method 200 can also generate directions from the current location of the requesting device to the location of the vehicle device. Method 200 may provide the directions in different forms, such as, for examples, audible, textual, visual (highlighted route on a map), or graphical (compass needle or other indicator pointing toward the location of the vehicle.)

One skilled in the art will appreciate that the systems and methods described above may have utility in embodiments and scenarios other than just determining a location differential value between a mobile user device and a vehicle, and then deciding whether to provide the vehicle's location information to the requesting device. In addition, instead of determining the location of a vehicle device, the systems and methods described above can also determine the location of a wireless mobile user device, smartphone, MID, etc., with respect to another wireless mobile user device, smartphone, MID, etc.

The methods and systems described above can cause many actions based on a result of comparing the location differential value to a predetermined criteria. For example, a user may wish to call a cab. Rather than call a cab company or having a hotel concierge call the cab company and request a cab for the user, the user can easily request the cab from an application running some, or all, of the steps of method 200. With an application running on its wireless mobile device (perhaps a given taxi company provides the application for the user's device) a user can request a cab at his, or her, current location. The central computer, operated by the taxi company, or a third party services provider, such as, for example, a telematics services provider, can determine the closest cab to the user's location and send instructions to the cab driver to go to the user's location. A telematics device, such as a TCU, can receive the instruction along with the user's current location. Or, a wireless mobile device of the cab driver can receive the instructions and location information. The central computer can determine the cab that should go to the user based on a simple straight line location differential, so that the cab closest to the requesting user 'as the crow flies' receives the instruction. Alternatively, the central computer can determine a cab to send to the user based on a travel time differential that considers street geography (e.g., one-way streets between the cabs in a fleet of cabs and the user) and also based on current traffic patterns.

In another aspect, if both the user and the user device are moving, and the device that the requesting device requests the location of is moving, the central computer can determine the best device or vehicle (i.e, closest to the requesting device) and instruct that best device to stop moving so a potential customer can make his way, or her way, to the deemed best device, vehicle, vendor/asset/personnel (mobile hot dog/ice cream vendor in a park, horse drawn carriage, taxi, tow truck, service technician vehicle, closest family member or friend, emergency responder, law enforcement, vendor at a convention center, etc.) or other asset that the user would like to locate and go to such as a vendor at an outdoor vehicle show. In an aspect, method 200 may run substantially on a user's wireless mobile device, or on a device substantially proximate the vehicle (vehicle device fixed or coupled to the vehicle or asset, or a smartphone or MID proximate the vehicle or asset or personnel), or other asset of which a user seeks the location. In these embodiments, the central computer typically still performs gate keeping functionality for security and confidentiality purposes. For example, if the central computer deems that the location differential value meets the predetermined criteria (e.g., the value is less than a predetermined limit) the central computer can pass the vehicle's location, or other asset's location, to the requesting user's wireless mobile device. As the user walks, or drives his vehicle toward the asset he seeks, the method running on his user device can update the location differential value and also update the user's current location on a map, or otherwise update the user's location with respect to the location of the asset he seeks. Thus, the central computer performs the function of initially vetting the request message to ensure that the request is from a legitimate device (or a device that the central computer associates with the asset sought) and that the location differential value meets predetermined criterion, or criteria. These steps help ensure that an unauthorized user cannot obtain the location of the vehicle/asset sought, and that an authorized user cannot obtain the location of the vehicle/asset for a nefarious purpose (seeking a stolen vehicle, tracking a fleeing spouse, domestic abuse victim, etc.) And, after the central computer confirms the request meets the predetermined criterion, or criteria, the central computer passes the sought asset's location information to the requesting user's wireless mobile device for further processing and updating of its location with respect to the location of the sought asset. Running the steps of updating the location differential value, or the steps of updating the location information, updating the mapping and directions, etc. at the requesting wireless mobile device reduces air time charges that an operator of network 112 shown in FIG. 1 would charge for use of the network by device 104.

In another aspect, some of the steps running on the vehicle device, or a device proximate the vehicle, can advantageously update the location differential value as the vehicle, or other asset, moves. This also reduces airtime charges to the vehicle device, because it would not need to periodically report its location information to the central computer over cellular telephony network 112. In addition, after the central computer determines that it has received a legitimate location request from a user's wireless mobile device, it can convey this determination to the device proximate the vehicle and to the requesting wireless mobile device such that the two device can communicate directly with one another, for example over a medium range wireless network 120, such as, for example, a wi-fi network, or equivalent thereof. Often, providers offer free access to wi-fi networks, or commercial establishments offer free access to wi-fi networks to entice customers to come to their place of business.

The invention claimed is:

1. A method for providing the location of a particular vehicle to a user device that is remote from the particular vehicle, comprising:

receiving a location request message that specifically requests the location of a particular vehicle, wherein the particular vehicle has a unique vehicle identifier associated with it, and wherein the location request message refers to the particular vehicle associated with the unique vehicle identifier;

obtaining location information of the particular vehicle;

obtaining location information of the user device;

evaluating the location information corresponding to the particular vehicle and the location information corresponding to the user device to generate a location differential value;

comparing the location differential value to at least a predetermined criterion;

generating a result of the comparison;

causing an action based on the result of the comparison;

wherein the location information of particular vehicle and the location information of the user device are location coordinates; and wherein the step of causing an action includes causing the user device to produce a location request denial message and includes causing the user device to display a visible message that the request has been denied if the location differential value exceeds the predetermined criteria, wherein the predetermined criteria is a distance limit.

2. The method of claim 1 wherein the obtaining of location information of the vehicle includes retrieving recently stored location information transmitted from a location determining device in the vehicle.

3. The method of claim 1 wherein the obtaining of location information of the vehicle includes requesting that a location determining device in the vehicle wirelessly transmit the location information.

4. The method of claim 1 wherein the obtaining of location information of the vehicle includes retrieving the location information generated by a location determining device in the vehicle and recently stored by it.

5. The method of claim 2 wherein the obtaining of location information of the vehicle includes retrieving from the user device the location information generated by a location determining device in the vehicle, wherein the location information of the vehicle was previously transmitted to and stored on, the user device.

6. The method of claim 2 wherein the obtaining of location information of the vehicle includes retrieving from a central computer located remotely from the vehicle the location information generated by a location determining device in the vehicle and transmitted to the central computer.

7. The method of claim 1 wherein the at least one predetermined criterion includes a distance limit of one mile.

8. The method of claim 1 wherein the step of causing an action based on the result of the comparison includes providing the location of the vehicle to the requesting device.

9. The method of claim 1 wherein the location differential value is a straight line position differential value.

10. The method of claim 1 wherein the differential value is a travel time differential value.

11. A central computer configured to perform a method for providing the location of a particular vehicle to a user device that is remote from the particular vehicle, the method comprising:

receiving a location request message that specifically requests the location of a particular vehicle, wherein the particular vehicle has a unique vehicle identifier associated with it and wherein the location request message refers to the particular vehicle associated with the unique vehicle identifier;

obtaining location information of the particular vehicle;

obtaining location information of the user device;

evaluating the location information corresponding to the particular vehicle and the location information corresponding to the user device to generate a location differential value;

comparing the location differential value to at least one predetermined criterion;

generating a result of the comparison;

causing, an action based on the result of the comparison;

wherein the location information of particular vehicle and the location information of the user device are location coordinates; and wherein the step of causing an action includes causing the user device to produce a location request denial message and includes sending a message to be displayed on the user device that the request has been denied if the location differential value exceeds the predetermined criteria, wherein the predetermined criteria is a distance limit.

12. The method of claim 11 wherein the obtaining of location information of the vehicle includes retrieving recently stored location information transmitted from a location determining device in the vehicle.

13. The method of claim 11 wherein the obtaining of location information of the vehicle includes requesting that a location determining device in the vehicle wirelessly transmit the location information.

14. The method of claim 11 wherein the at least one predetermined criterion includes a distance limit of one mile.

15. The method of claim 11 wherein the step of causing an action further includes causing the user device to audibly play a message that the request has been denied.

16. The method of claim 11 wherein the location differential value is a straight line position differential value.

17. The method of claim 11 wherein the differential value is a travel time differential value.

18. A user device configured to perform a method for providing the location of a particular vehicle that is remote from the user device, the method comprising:

receiving a location request specifically requesting the location of a particular vehicle from a user interface;

transmitting location information of the user device to a central computer;

requesting location information of the particular vehicle from the central computer;

receiving location information of the particular vehicle;

evaluating the location information corresponding to the particular vehicle and the location information corresponding to the user device to generate a location differential value;

comparing the location differential value to at least one predetermined criterion;

generating a result of the comparison;

causing an action based on the result of the comparison;

wherein the location information of particular vehicle and the location information of the user device are location coordinates; and wherein the step of causing an action includes causing the user device to produce a location request denial message and includes sending a message to be displayed on the user device that the request has been denied if the location differential value exceeds the predetermined criteria, wherein the predetermined criteria is a distance limit.

* * * * *